United States Patent [19]

Staples

[11] 4,166,781

[45] Sep. 4, 1979

[54] RECOVERY OF SILVER FROM HYPO

[76] Inventor: Stanley F. Staples, 354 S. Pickett St., Alexandria, Va. 22304

[21] Appl. No.: 826,659

[22] Filed: Aug. 22, 1977

[51] Int. Cl.[2] ..... C25C 1/20; C25C 7/00; C25C 7/02

[52] U.S. Cl. ..... 204/109; 204/228; 204/275

[58] Field of Search ..... 204/109, 228, 140, 149, 204/274, 275, 272, 273

[56] References Cited

U.S. PATENT DOCUMENTS

| | | | |
|---|---|---|---|
| 2,110,930 | 3/1938 | Doffin | 204/109 |
| 3,524,805 | 8/1970 | Engelman | 204/228 |
| 3,715,291 | 2/1973 | Bentley | 204/109 |
| 3,767,558 | 10/1973 | Rowe | 204/109 |
| 3,959,110 | 5/1976 | Burgess | 204/109 |
| 4,018,658 | 4/1977 | Alfin et al. | 204/228 |

*Primary Examiner*—R. L. Andrews

[57] ABSTRACT

Means to plate silver from photographic hypo combines an electrolytic cell having a plating cathode with means to feed hypo solution to the cell at various constant volume supply rates and with means to supply electric energy to the cell comprising means to restrict and maintain the voltage and amperage thereof within maximum values to various constant rates corresponding to the respective constant hypo supply rates. In the cell hypo supply first moves slowly in heat-absorbing contact with a non-plating portion of the cathode, then into a plating zone.

14 Claims, 3 Drawing Figures

RECOVERY OF SILVER FROM HYPO

This invention relates to electrochemical recovery of silver from used or waste photographic fixing solutions. The used solutions have "fixed" the image on a photographic surface by removing silver compounds, the sensitizing agent, after exposure to light or to certain electric forms of energy. The usual fixing agent is sodium thiosulfate, also known as sodium hyposulfite, including waste hypo- termed "hypo" in the art (and in this description and claims). Typical waste solutions range from approximately 0.2 to 1.6 ounces of silver the gallon (herein Troy ounces and U.S. gallons). This invention applies to the waste hypo solutions broadly but 1.6 ounces will be taken to illustrate this invention.

Attempts to solve problems in electrochemical plating of silver from used hypo solutions have developed extensive prior art. Yet recoveries are faulty and partial. They lose large quantities of silver from the economy, they pollute water streams and they waste energy. Likewise is the extensive practice of discarding used hypo to avoid labor costs and inaccuracies of manual controls. In many cases the intended recovery does not justify automatic facilities because they are too intricate or too expensive. Also quite commonly electrolytic systems unduly "burn" or blacken the recovered silver, so burdening subsequent smelting or purification.

Objects of this invention are to combat these and other faults.

The art well knows that treatment of spent hypo solution in an electrolyzing cell causes silver hypo complexes to separate into parts (ions). On application of unidirectional electric energy, silver ions bearing positive electric charges ultimately appear at the (negative) cathode. These silver ions yield their positive electric charges (electrons) to the cathode, while depositing, or plating, metallic silver on the cathode. The operations consume electric energy, or transpose it to a lower level, with losses in heat and in chemical side-reactions. Of these latter, production of sulfide is especially deleterious, not only during the chemical reactions that produce it but in its blackening effect on the plated silver.

The prior art recognizes that these electrochemical actions are complex and elusive and continually changing. Yet the proposals for control, though many and various, depend on attempts to respond to changing conditions within the cell itself as the changes occur. Thus:

U.S. Pat. No. 1,866,701 Garbutt 1932 states, "The chemistry relating to the electrolysis of hypo solutions is very complex" (page 1 line 96). He combats the tendency within the cell to form special conditions by "vigorous agitation" of the hypo solution with streams of air in the cell.

U.S. Pat. No. 1,876,830 Balassa 1932 provides a pair of rods in a side conduit of a fixing tank for one rod to act as cathode to receive the silver deposit. He depends on rising of revivified hypo for its return to the tank "by the constant de-plating of the solution" (page 3 lines 48–49).

U.S. Pat. No. 1,900,893 Hickman 1933 (application 540,620) describes his principal process for electrolytic recovery of silver from used hypo. His many control elements, including a Wheatstone bridge, change varying operations according to fluctuating conditions within the cell.

U.S. Pat. No. 1,954,316 Hickman 1934 likewise notes "the very complex chemistry" is silver recovery and the tendency to sulfide (page 2 lines 40–50). He attempts to operate as dictated by faulty silver conditions within the cell with "violent mechanical agitation" of the hypo (page 1 line 36 and page 3 line 23).

U.S. Pat. No. 1,959,531 Hickman 1934 (application 540,621), referred to in other Hickman (Eastman Kodak) patents, has a series of electrolyzing compartments with variable speed arms for "violent agitation" and pumped recirculation of the hypo solution, as he alters the sulfide content of the cell.

U.S. Pat. No. 2,110,930 Doffin 1933 manually switches voltage adjustments in the silver recovery cell as certain tests within the electrolyzing cell dictate.

U.S. Pat. No. 3,072,557 Mandroian 1963 emphasizes the internal "potential with respect to the elctrolyte" (col. 1 lines 30–31) of several pairs of electrodes. He has a special sensing electrode in the hypo to change voltage continuously by feedback through a transformer and so maintain electrode-solution potential as cell conditions change (col. 5 lines 36–51).

U.S. Pat. No. 3,477,926 Snow 1969 has a perforated anode inside a stationary cathode with agitator vanes therebetween. He pumps hypo through the anode at random rates "to solve the agitation problem" (col. 2 line 11).

U.S. Pat. No. 3,551,318 Snook 1970 uses special internal sensing means within a hypo plating solution to determine changes so as to change the plating current.

These patents fairly show and typify the best prior art in the judgment of this applicant. The present invention in electrolyzing used hypo solution differs radically from previous procedures. They in theory and practice sought to control the electrochemical actions according to conditions as they change within the silver recovery cell. This invention, regardless of changes within the cell during operation, integrates actuating factors originating outside the cell; it maintains a constant volume rate of hypo supply through the cell and responsive to that supply flow automatically maintains at the cell electrode terminals a supply of restricted or limited silver-plating electric energy at constant voltage and amperage corresponding to the given or respective rate of hypo supply. This invention provides a system not dictated by changes of conditions within the electrolysis cell. It combines means to apply and maintain constant at the cell terminals the actuating or vivifying factors of hypo and electric energy.

Preferably in the present examples the electric power applied will be controlled or dominated by the substantially constant maximum voltage component of the order of one volt. At relatively higher volume rates the respective corresponding amperage component becomes dominant at about two amperes, within the cut-off maximum of three amperes. Power limiting means automatically maintains the respective commensurate values.

FIG. 1 of the attached drawings shows, partly schematically, in combination (1) an electrolyzing cell to plate silver from hypo solution, the cell having certain solution flow and cathode arrangements to favor thorough-going silver recovery to low levels, (2) together with means to restrict hypo supply to various constant volume rates of flow and, of choice, to control admission of actuating factors to the cell, (3) together with electric control means adapted to limit voltage and amperage applied to the cell to values corresponding respectively to the rates of hypo supply within fixed maximum values.

This description now proceeds with specific illustration of a preferred embodiment of this invention, with reference to the drawings.

Figure 1:
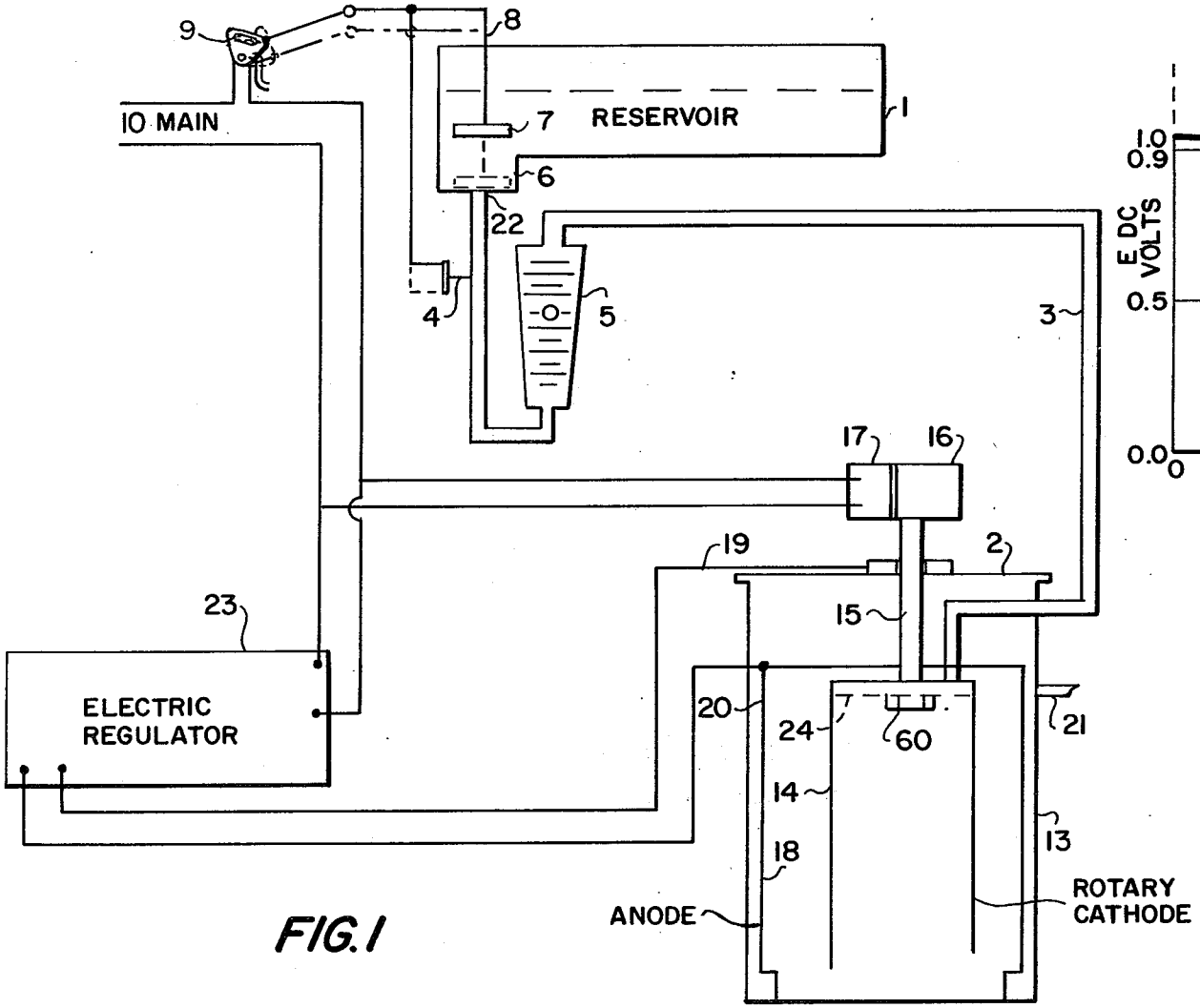

FIG. 1 shows reservoir 1 to supply hypo solution by gravity to electrolyzing cell 2 through conduit 3. Conduit 3 contains adjustable means, for example, regulating valve 4, to restrict flow of the solution to various selectable constant volume rates, indicated by flowmeter 5, of choice of type. Conduit 3 receives hypo solution from well 6 in reservoir 1. Well 6 serves not only to drain the reservoir into conduit 3 but also to receive float 7 closure means. With solution in the reservoir, float 7 rises suitably to operate through connection means 8 to close switch 9 in electric main 10 to apply power to cell 2. Main 10 is a conventional 120 volt line, polyphase if available, connected to rectifier means. Switch 9 may be a conventional tilting mercury switch or equivalent of choice. Also, valve 4 in conduit 3 is indicated as being connected to close switch 9 when solution flows in conduit 3 and to open switch 9 when conduit 3 is closed against flow of hypo solution. Dotted lines in the drawing indicate closed position of both float 7 and valve 4. Thus the hypo supply comprises means to control actuation of cell 2 by hypo and electric power.

The following cell and electrode arrangements are preferred to meet the particular conditions of this invention. The cell 2 element of the combination shown in FIG. 1 comprises container 13 to hold a body of hypo solution to immerse cathode 14 and anode 18, with particular means to feed the hypo through the cell.

Cathode 14 is suspended at its top 24 by rod or shaft 15, held by easily removable fastening means such as nut 60. Preferably, though of choice, shaft 15 connects through speed reduction means 16 with motor 17, to rotate cathode 14. The cathode is shown as a hollow open-bottom cylinder of closed-wall smooth sheet metal, as No. 316 stainless steel common in this art. Anode 18 rising somewhat above the cathode rests on its bottom lower than the cathode. Anode 18 may be cylindrical and close to the walls of container 13 but those skilled in the art may provide other arrangements. The anode is of carbon, as is common in this art.

Some rotation of the cathode is desirable but relatively slow rates are adequate. In the illustration given, one revolution a second is acceptable but the rate may be as low as ten revolutions a minute. These are not fixed limits. It is not necessary to resort to the "violent agitation" shown in the prior art.

Cathode means 14 preferably is about 10 inches high, about 5¾ inches in diameter, and spaced concentrically about ⅞ inch initially from the anode. The cathode wall is about 1/32 inch thick for stiffness to support a build-up of about ¼ inch of silver plate. As shown cathode 14 is immersed in hypo to the level of outlet 21, or about 8½ inches. As shown the electrodes divide the body of hypo into a major area within the hollow cathode and a narrower area between cathode and anode. This major area is away from the anode, for practical purposes free from electrolyzing conditions. The inner face of the cathode wall for practical purposes is a non-plating surface with the electric current flowing directly across the zone between anode and the outer face of the cathode wall. There is no need to coat the inner face of the cathode with insulator material as that face plates out substantially no silver unless traces at times. The narrower area of the hypo body between cathode and anode is under electrolyzing conditions so the outer face of the cathode wall plates out the silver. This outer face contacts an area where electrolyzing conditions release heat, which is received by the cathode wall and transferred to the inner wall face.

Hypo supply from reservoir outlet 22 flows by gravity through conduit 3, enters cell 2 through perforated top 24 of hollow cylindrical cathode 14, immersing both cathode and anode, and flows through cell 2 to leave at outlet 21, somewhat lower than reservoir outlet 22. Various constant volume rates of hypo supply are selectable. In this illustration these values for commercial waste hypo range from ½ to 1½ gallons. an hour, preferably about ¾ gallons for a silver content of about 1.6 ounces a gallon. As shown, cathode 14 serves as a relatively large conduit for the entering hypo solution, providing a major area for the nonelectrolyzing flow over three times as large as the area between cathode and anode. Thus entering hypo moves relatively slowly to its exit at the cathode open bottom, then relatively rapidly through the more narrow plating zone as it rises to outlet 21. The hypo descending within cathode 14 tends to equalize any variations in the supply and it is in heat-absorbing contact with the non-plating inner face of the cathode wall. The electric energy applied to the cell terminals 19 and 20 and the chemical reactions involved concentrate their heating action in the relatively narrow electrolyzing zone between the electrodes where the hypo flow is in its final travel.

Unit 23 is electric control means entirely separated from electrolyzing cell 2 but connected to supply unindirectional plating power from main 10 to the electrode terminals. This element of the combination is shown in FIG. 1 as a block drawing, also shown in circuit diagram in FIG. 2. Essentials of the preferred arrangement within limiter control 23 are described in detail so that those skilled in the art may provide this unit or its equivalent or adapt it to other dimensions of use to practice this invention.

Figure 2:
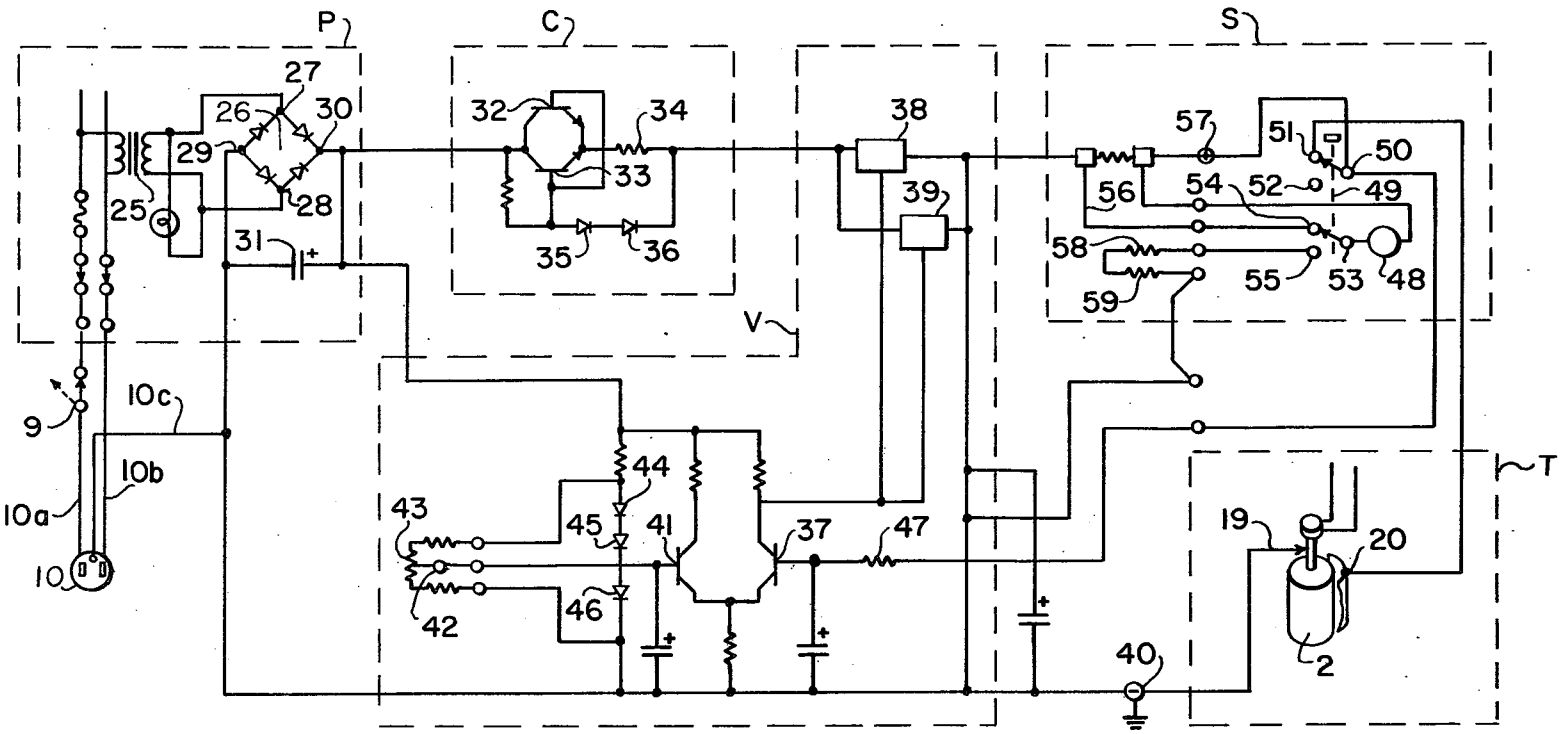
FIG. 2 shows in diagram the electric limiter circuit referred to in FIG. 1 to fix and to maintain the voltage and the amperage values applied to the cell.

FIG. 2 shows unit 23 containing five principal areas, each in dashed outline and marked respectively P(power), C(current), V(voltage), S(switch), and T(terminals). These are described in the order stated, in which electric energy passes from power main 10 to terminals 19 and 20 of cell 2.

Area P receives power from a conventional alternating current power main 10 through lines **10*a* and 10*b*, having ground line 10*c*. The line 10 contains main switch 9 opened or closed by the hypo solution supply of conduit 3 from reservoir 1, as already described under FIG. 1. Power from main 10 passes through step-down transformer 25 to full-wave rectifier 26, which has inlet terminals 27,28; also terminal 29 to ground 40 and outlet terminal 30, with common capacitor 31** to smooth the rectified, or now unidirectional, current. This is a known full-wave bridge rectifier means with smoothing filter capacitor.

Area C shows the current limiter means, which prevents rise of the current to cell 2 beyond the desired value corresponding to a given constant rate of hypo supply. This comprises transistors 32, 33 in parallel to the line from the P area, followed by resistance 34 in the outlet line to the V area and to the S area. If current through resistance 34 exceeds the desired design value, say three amperes, the resulting voltage drop across resistance 34 rises sufficiently to overcome the barrier voltage of the string of diodes 35, 36 shown in parallel to transistors 32, 33. This causes the diodes to begin to conduct. Diodes such as these act only at a given voltage. This barrier voltage for a silicon diode as shown is approximately 0.7 volt. Thus the string of diodes 32, 33 conducts at 1.4 volts. This imposes a counter bias to the bases of transistors 32, 33 causing them to begin to limit further rise in voltage of the current through resistance 34 to the desired design value. Hence current imposed on cell 2 is limited so as not to exceed the selectable design value, in this instance three amperes maximum.

Area V of the electric limiter is the voltage regulator area. It contains transistor 37 connected to the power line from rectifier 26. Both of these connect to transistors 38 and 39 in parallel in the load line from current limiter area C. When transistor 37 receives variation in voltage it affects transistors 38 and 39 which are in proper sense to readjust that voltage to its normal design value by appropriate variation of their impedance. They thus bring terminal 38, which is in the power line to area S, to normal as well as the plus or anode terminal 20 of cell 2. It will be observed that both the cathode terminal 19 of cell 2 and the base of transistor 37 are connected to ground, shown as terminal 40. To set or to adjust voltage regulator transistor 37 and bring to desired normal the voltage at terminal 57, transistor 41 is connected in a differential circuit with transistor 37 between the power line from rectifier 26 and ground 40. Transistor 41 provides range adjustment for the voltage regulating circuit. In order to adjust the regulated output voltage over its design range, an adjustable reference voltage is required at the base of transistor 37. This is provided by potentiometer 42 having adjustable resistance element 43. The potentiometer is provided with constant potential across its terminals at element 43 by connection at one end to ground or negative terminal 40 of the power supply and at the other end to the top or anode end of a string of three silicon diodes in series, 44, 45 and 46. These have their cathode end at 46 connected to the negative ground 40. These three diodes limit the potential across the potentiometer to their barrier 2.1 volts. This gives the potentiometer a reference voltage for transistor 37 regardless of changes in its line voltage, which is above their barrier voltage. In order to prevent removing all load across the regulated line when potentiometer 42 is adjusted, resistance 47 in the transistor 37 circuit continuously provides a small current of the order of two hundred milliamperes to permit adjustment of potentiometer 42.

Area S contains meter 48 with double pole double throw switch 49 having base terminal 50 with pole terminals 51, 52 and base terminal 53 with pole terminals 54, 55. The normal position of switch 49 is up as shown in the drawing, being spring loaded or a toggle switch. Normally meter 48 shows the load current to the cell terminal that passes through meter shunt 56 in the power line. Alternatively, when switch 49 is held closed briefly in down position in the drawing, current through the meter 48 is cut out and open circuit voltage shows on the meter, taken between the power line near terminal 57 through the meter and multiplier resistance 58 and 59 to the ground potential 40 of terminal 19 of cell 2.

Figure 3:
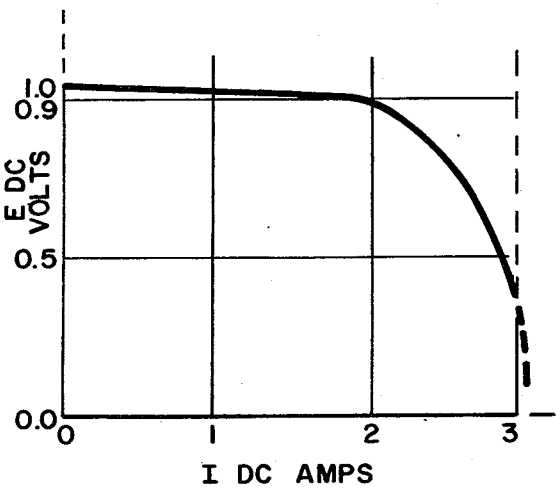
FIG. 3 shows a curve of an infinite number of voltage and amperage rates within maximum values, automatically imposed by the electric limiter as constant rates to the electrolyzing cell terminals, in correspondence to various respective constant volume rates of hypo supply.

FIG. 3 shows a graph of the restricted electrical factors that are imposed on the terminals 19, 20 of electrolyzing cell 2. Currents up to three amperes are shown as abscissae and EMF (electromotive force) up to about one volt shown as ordinates in the stated illustration of this invention. This is not a curve of conditions within cell 2 during electrolysis; it is not necessary to ascertain them. The curve shows the electrical factors as applied by the electric limiter to the cell terminals for a corresponding infinite variety of constant hypo supply flows, within the general commercial range of 0.25 to 1.6 ounces of silver the gallon. As shown by the straight EMF line the electric limiter applies the order of one volt over an extensive lower range until the current reaches the order of 2 or 2.2 amperes. Over this range the applied one volt is dominant in control of the cell operation. Then the asymptotic curve breaks sharply with current increase up to the cut-off at about three amperes maximum. In this range the current limiter or amperage flow is in control. The voltage or EMF factor loses significance rapidly, as the curve shows. Operating at about the preferred 2.2 ampere point, the waste hypo solution yields substantially all its silver to the cell cathode, practically to about 0.02 ounces a gallon.

A useful way of operating this invention is simply to fill cell 2 with the hypo solution (illustrated by 1.6 oz. silver a gallon) and plug the apparatus into the electric supply main. At the 2.2 ampere point from the current limiter, open the hypo supply and set the supply rate of hypo from reservoir 1 at substantially ¾ gallon an hour. This constant supply rate will be indicated by flowmeter 5. The corresponding constant amperage (about 2.2) to the terminals of cell 2 will be indicated on limiter meter 48. With other hypo solution, cell 2 may be filled and the hypo supply be opened, to a selectable constant volume rate, indicated by flowmeter 5, at which electric meter 48 shows the controlled electric rate to be at the corresponding point identifiable on the curve of FIG. 3. The electric limiter control 23 maintains the rates of voltage and amperage at the cell terminals.

Time factors of this invention aid the combinations involved to meet objects of combatting problems of this art and avoiding waste of silver and of energy.

In accordance with the patent statutes and practice the foregoing written description and accompanying drawings describe this invention and the manner and process of making and using it in the prescribed terms to enable any person skilled in the pertinent art to make and use the same, and set forth its preferred embodiment and the best mode contemplated by the inventor of carrying out this invention. Others may now make various changes and adaptions and perceive various equivalents to meet present and other conditions for which this invention is useful. Novel and useful features of this invention are particularly and distinctly pointed out in the appended claims defining this invention.

What is claimed is:

1. An improved process of treating hypo solution and recovering silver therefrom, comprising flowing a supply of hypo solution between anodic and cathodic electrode means in an electrolyzing operation, applying silver-plating electric energy to the electrode means, automatically maintaining the amperage and the voltage of the applied energy responsive to and each at constant value corresponding to the constant volume flow rate of the hypo supplied to the electrode means, and automatically restricting the amperage to within an upper limit.

2. An improved process for recovering silver from hypo as in claim 1 in which the voltage value of the silver-plating electric energy applied to the electrodes relative to the amperage automatically is restricted to lower relative value with any increase of amperage.

3. Improvement in process for treating hypo solution and recovering silver therefrom, comprising forming a body of hypo solution having a major area and a narrower area, causing the hypo in the narrower area to flow between anodic and cathodic electrode means in an electrolyzing cell, causing the hypo in each area to contact the cathodic means, causing silver-plating electric energy to flow across the stated electrode means through the narrower area of hypo whereby to plate out electrolyzed silver on the cathodic means from the narrower area, causing the cathodic means to receive heat and transmitting heat from the cathodic means to hypo solution in the major area to dissipate the heat, conducting a flow of incoming hypo solution through the major area at a constant rate with respect to volume and a slow rate of speed with respect to speed of flow in the narrower area and then, continuing the constant rate with respect to volume, causing the hypo to flow from the major area through the narrower, plating area at a more rapid rate of speed relatively to the stated major area.

4. A process to recover silver from hypo as in claim 3, having a flow of hypo solution in contact with cathodic electrolytic plating means, comprising flowing the hypo solution at constant volume rates in contact with the cathodic plating means and supplying to the solution electric plating energy at constant voltage and at constant amperage corresponding respectively to the constant volume hypo flow rate.

5. A process to recover silver from hypo as in claim 4, applying electric plating energy to hypo solution at constant values of voltage and of amperage, in which the voltage is of the order of within an upper limit of one volt and the amperage is within an upper limit of of the order of three amperes.

6. A process to recover silver from hypo as in claim 3, having a flow of hypo solution at a constant volume rate in contact with cathodic electrolytic plating means, in which the hypo flow is at a constant volume rate in the range of ½ to 1½ gallons an hour.

7. Apparatus having improved means to to recover silver from photographic hypo solution comprising in combination: (1) electrolyzing cell means to contain a body of hypo and plating cathode means, (2) means to supply flow of hypo solution into contact with the cathode means comprising means to select a rate from various constant volume rates of flow of the hypo supply to the cathode, and (3) means to supply electric energy to the cell means along with the supply silver-plating of hypo comprising means automatically to restrict and to maintain the voltage and the amperage of the electric supply to respective constant values corresponding to the constant rate of the hypo supply.

8. Apparatus as in claim 7 to recover silver from hypo in which the means to select the constant volume rate of flow of the cathode hypo supply comprises adjustable means to alter the volume rate of flow of the hypo to the cathode and meter means to indicate the altered flow rate.

9. Apparatus as in claim 7 to recover silver from hypo, comprising means to control admission of hypo and of electric energy to the cell, in which the means of hypo supply to the cathode contains means to cut off the admission of electric energy in absence of flow of the hypo supply.

10. Apparatus as in claim 7 comprising electrolyzing cell means to plate silver from hypo, containing cathode plating means, in which the cathode means comprises a hollow solid-wall cylinder with open bottom above the cell bottom, the wall having a plating face the cell containing anode means spaced from the cathode plating face to form therewith an electrolyzing zone between the two with hypo supply in said open bottom.

11. Apparatus as in claim 7 comprising electrolyzing cell means to plate silver from hypo, having means to restrict supply of electric energy to the cell, in which the said restricting means automatically limits the voltage of the electric supply to an upper limit of the order of one volt and the amperage an upper limit of to the order of three amperes.

12. Apparatus as in claim 7 to recover silver from flow of hypo solution, comprising electrolyzing cell means, wherein the stated plating cathode means is solid-wall and comprises both plating face means and separate face means to contact the hypo flow and wherein the cathode plating face means comprises means to receive and to direct heat toward the separate face means and wherein the stated cell means comprises means to direct heat-absorbing flow along the separate face means of the stated cathode means.

13. Improvement in apparatus to treat hypo solution and recover silver therefrom, comprising an electrolyzing cell with anode and cathode electrode means, and means to maintain supply flow of hypo between the electrodes at constant rate with respect to volume, means to supply silver-plating electric energy to the electrodes, and electric restrictive means responsive to the hypo supply flow automatically to maintain the amperage and the voltage of the electric energy supply each to constant value corresponding to the hypo constant volume flow rate, and comprising automatic means to restrict the amperage and the voltage values to within respective upper limits.

14. Improved apparatus to recover silver from hypo as in claim 13 in which said electric restrictive means comprises means to maintain the voltage value relative to the amperage automatically at lower relative value with any increase of amperage.

* * * * *

UNITED STATES PATENT AND TRADEMARK OFFICE

CERTIFICATE OF CORRECTION

PATENT NO. : 4166,781

DATED : Sept. 4, 1979

INVENTOR(S) : Stanley F. Staples

It is certified that error appears in the above–identified patent and that said Letters Patent are hereby corrected as shown below:

Claim 7 Line 57 After "supply" insert - silver-plating - and

Line 58 Delete "silver-plating" after "supply".

Signed and Sealed this

Fourth Day of December 1979

[SEAL]

Attest:

SIDNEY A. DIAMOND

Attesting Officer

Commissioner of Patents and Trademarks